United States Patent [19]

Parrott

[11] Patent Number: 5,007,684

[45] Date of Patent: Apr. 16, 1991

[54] WATER SPRAY UNIT FOR MINING

[75] Inventor: George A. Parrott, Barnsley, England

[73] Assignee: Minnovation Limited, Barnsley, England

[21] Appl. No.: 475,335

[22] Filed: Feb. 5, 1990

[51] Int. Cl.[5] ..... E21C 35/22

[52] U.S. Cl. ..... 299/81; 175/424; 239/600

[58] Field of Search ..... 299/12, 17, 81; 175/393, 424; 239/600

[56] References Cited

U.S. PATENT DOCUMENTS

| | | | |
|---|---|---|---|
| 3,101,906 | 8/1963 | Webber | 239/600 X |
| 3,876,253 | 4/1975 | Parker | 175/393 X |
| 4,333,687 | 6/1982 | Barnstorf | 299/17 X |
| 4,668,018 | 5/1987 | Demoulin et al. | 299/81 |

FOREIGN PATENT DOCUMENTS

| | | | |
|---|---|---|---|
| 1126766 | 6/1982 | Canada | 299/81 |

*Primary Examiner*—Ramon S. Britts
*Assistant Examiner*—David J. Bagnell
*Attorney, Agent, or Firm*—R. A. Giangiorgi

[57] ABSTRACT

A water spray unit is provided, to be located in a receiving bore provided in a pick box. The unit comprises an elongate nozzle portion and a fastener for the nozzle portion. The nozzle portion has an internal water receiving chamber and a water inlet orifice communicates with the chamber. At one end of the nozzle portion, a water discharge orifice communicates with the chamber. An external screw thread is provided on the fastener and drive surfaces on the fastener serve to screw or unscrew the fastener. One end of the nozzle portion is distal from said fastener and terminates in a nose having a frustoconical sealing surface, adapted, in use, to be forced by the fastener, into tight, water sealing engagement with a complementary frustoconical seat of the receiving bore. The invention also includes a pick box provided with such a water spray and a rotary cutting head provided with such a pick box.

16 Claims, 5 Drawing Sheets

WATER SPRAY UNIT FOR MINING

This invention relates to a water spray unit for installation in a pick box of a rotary cutting head of a mining machine. The latter may be a so-called roadheader machine for driving tunnels or underground roadways, or a so-called shearer for mineral (particularly coal) winning operations. The invention also includes a pick box provided with such a spray unit and a rotary cutting head provided with an array of such pick boxes.

Water spray units are desirable in coal mining to spray water to a zone at the rear of a pick with a view to elimination of so-called incendive sparking. Clearly it is desirable that the spray unit shall be in a location where damage to it and blockage is minimised and for this purpose rear entry spray units have been developed. Basically, a blind bore to receive a spray unit is drilled into the rear of a pick box with a relatively fine through hole leading from the inner end of the bore to the front end of the pick box, through which fine hole water issuing from a discharge orifice of the spray unit, is adapted to pass, to reach the incendive sparking zone.

However, with prior constructions of spray units, difficulities have been encountered in achieving adequate sealing and clearly leakage of water is not only uneconomic, but potentially dangerous if insufficient quantities are being directed to the incendive sparking zone.

According to a first aspect of the present invention, there is provided a water spray unit adapted, in use, to be located in a receiving bore provided in a pick box, said water spray unit comprising an elongate nozzle portion and a fastener for said nozzle portion, an internal water-receiving chamber provided in said nozzle portion, a water inlet orifice in communication with said chamber and, at one end of side nozzle portion, a water discharge orifice in communication with said chamber, an external screw thread provided on said fastener and drive surfaces also provided on said fastener for screwing or unscrewing, with said one end of said nozzle portion being distal from said fastener and terminating in a nose having a frusto-conical sealing surface, adapted, in use, to be forced by said fastener, in tight, water-sealing engagement with a complementary frusto-conical seat of said receiving bore.

To be locatable in the receiving bore the nozzle portion is cylinder-like having a longitudinal axis. The water chamber is conveniently supplied with water via a radial extending water inlet orifice protected by a wire mesh filter sleeve retained by an 'O'-ring in a circumferential groove. Another 'O'-ring is located in a circumferential groove together with a pair of backing rings. The water discharge orifice is co-axial with the longitudinal axis, to provide a water spray.

The fastener has a longitudinal axis and the drive surfaces are conveniently provided by an internal hexagon socket, to receive an Allen key.

In a first embodiment, the nozzle portion and fastener are rigidly interconnected to form a one-piece spray unit, in a second embodiment, the nozzle portion and fastener are formed as separate elements to constitute a two-piece spray unit, while in a third embodiment, the nozzle portion and fastener are loosely interconnected via an articulated joint.

With the first embodiment, the fastener is provided with an integral, circular section nose, which is tight, push fit within a counterbored extension of the water chamber, the nose serving firstly as water plug for the end of the water chamber distal from the discharge orifice and secondly transmitting torque, and hence rotation, to the nozzle portion during screwing of the water spray unit, (to bring the frusto-conical nose into tight, water sealing engagement with the seat) or unscrewing of the water spray unit (for cleaning etc.).

In practice, however, tap wander, during cutting of the threads may frequently result in the thread not being aligned with insufficient accuracy with the bore. This would result in difficulties, or on some occasions the impossibility of inserting water spray units in accordance with the FIG. 1 embodiment.

This problem is overcome by the two-piece water spray unit of the second embodiment. In detail a bearing face of the fastener abuts an annular rib of the adjacent end of the nozzle portion, to push, and advantageously not necessarily to rotate, the nozzle portion along the bore until tight sealing engagement is achieved between the frusto-conical nose and the seat. Whilst this second embodiment of water spray overcomes the non-alignment problem, it was found that upon unscrewing of the fastener, the nozzle portion frequently remained stuck in situ.

This problem overcome by the third embodiment. In detail, the nose of the fastener functions as a ball of a ball and socket type articluated connection between the nozzle portion and the fastener. In detail, the nose has a neck, and a cupped end of the nozzle portion is crimped or swaged radially inwardly towards the neck with an annular clearance gap. Crimping or swaging can be effected during manufacture or alternatively can be effected in situ. In the latter case, the fastener may be provided with an annular skirt which with the external periphery of the nose, defines an inwardly tapering annular gap, into which the cupped end is progresively deformed during screwing of the fastener.

According to another aspect of the invention, there is provided a pick box to receive, releasably, a mineral cutter pick, provided with a rear entry bore in which is housed a water spray in accordance with the first aspect.

According to a third aspect, there is provided a rotary mineral cutting head, provided with an array of pick boxes in accordance with the second aspect.

The invention will now be described in greater detail by way of examples, with reference to the accompanying drawings in which.

Figure 3:
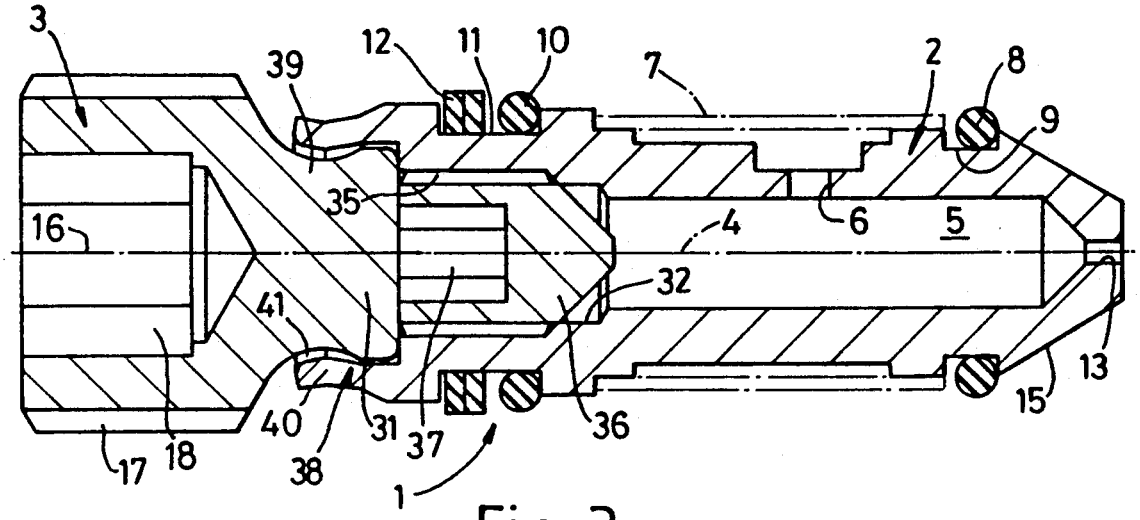
FIG. 3 is a longitudinal section through a third embodiment of water spray.
Figure 4:
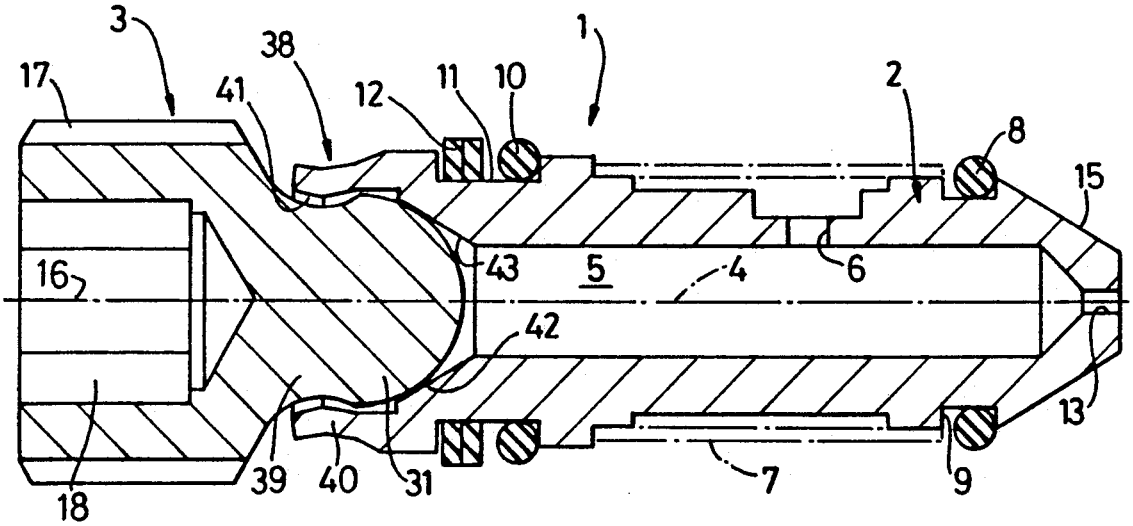
FIG. 4 is a longitudinal section through a fourth embodiment of water spray.
Figure 4A:
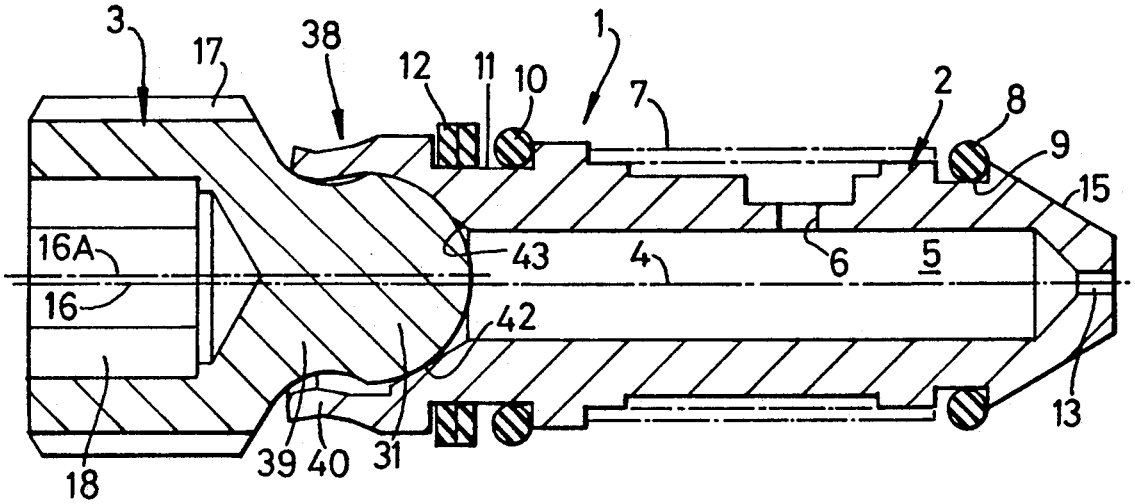
Figure 4B:
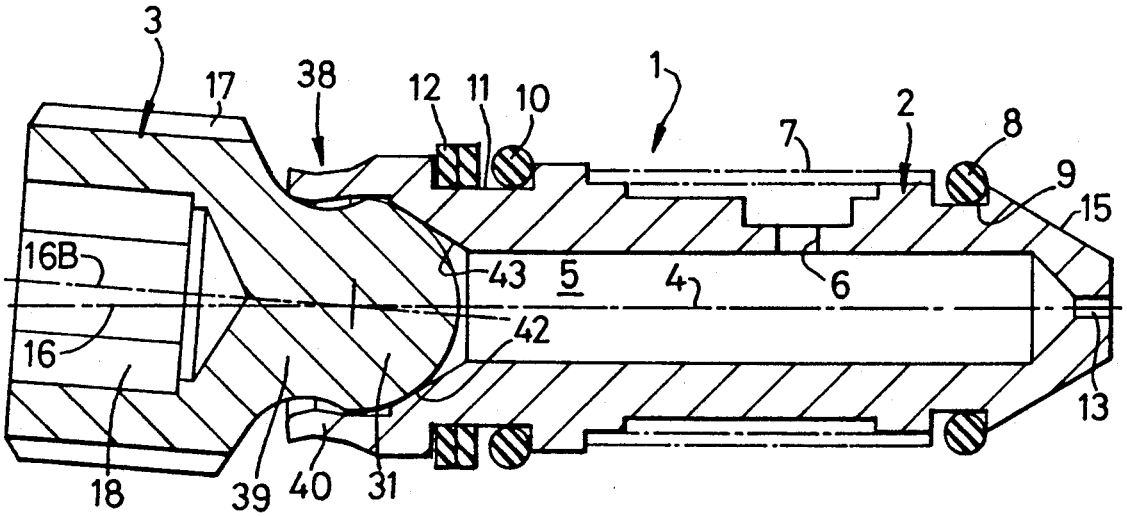
Figure 5:
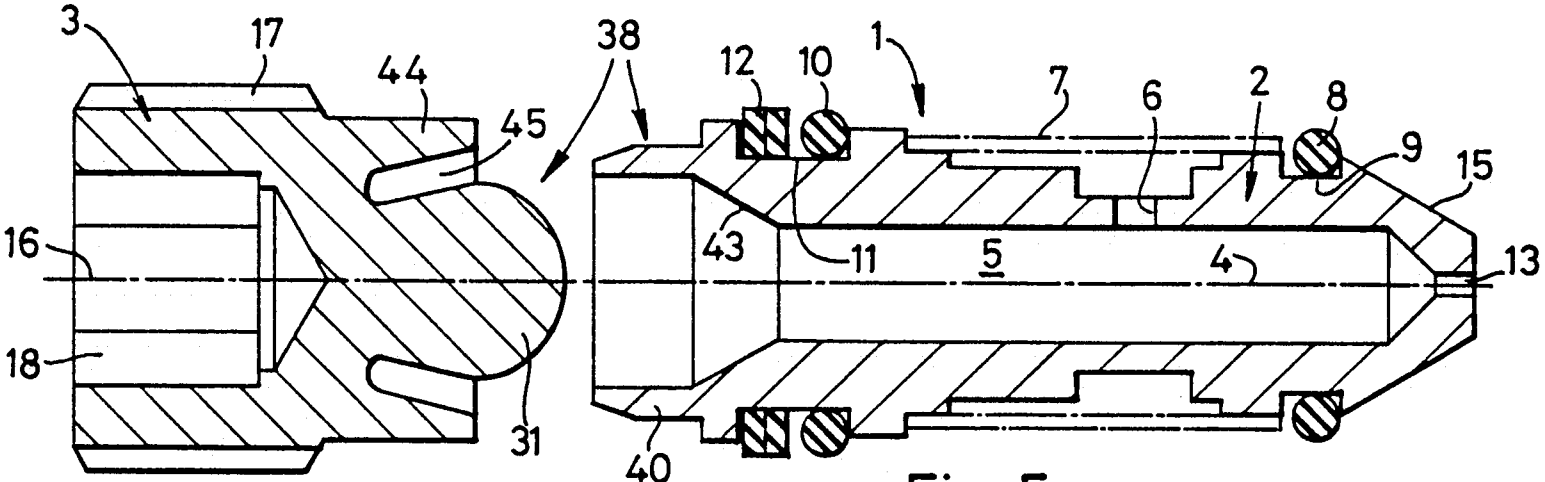
Figure 5A:
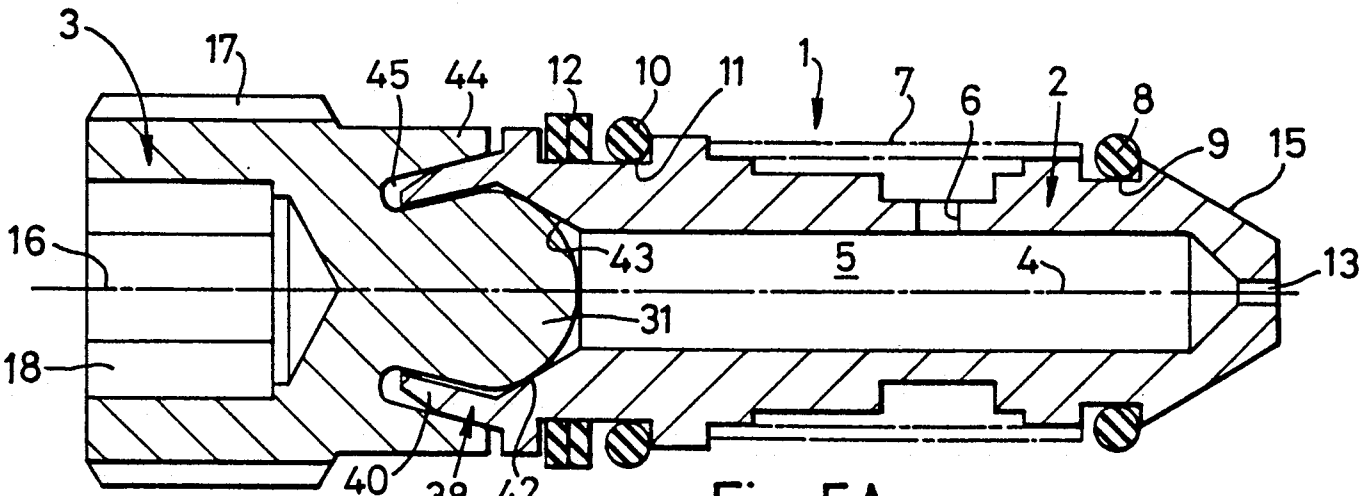
Figure 6:
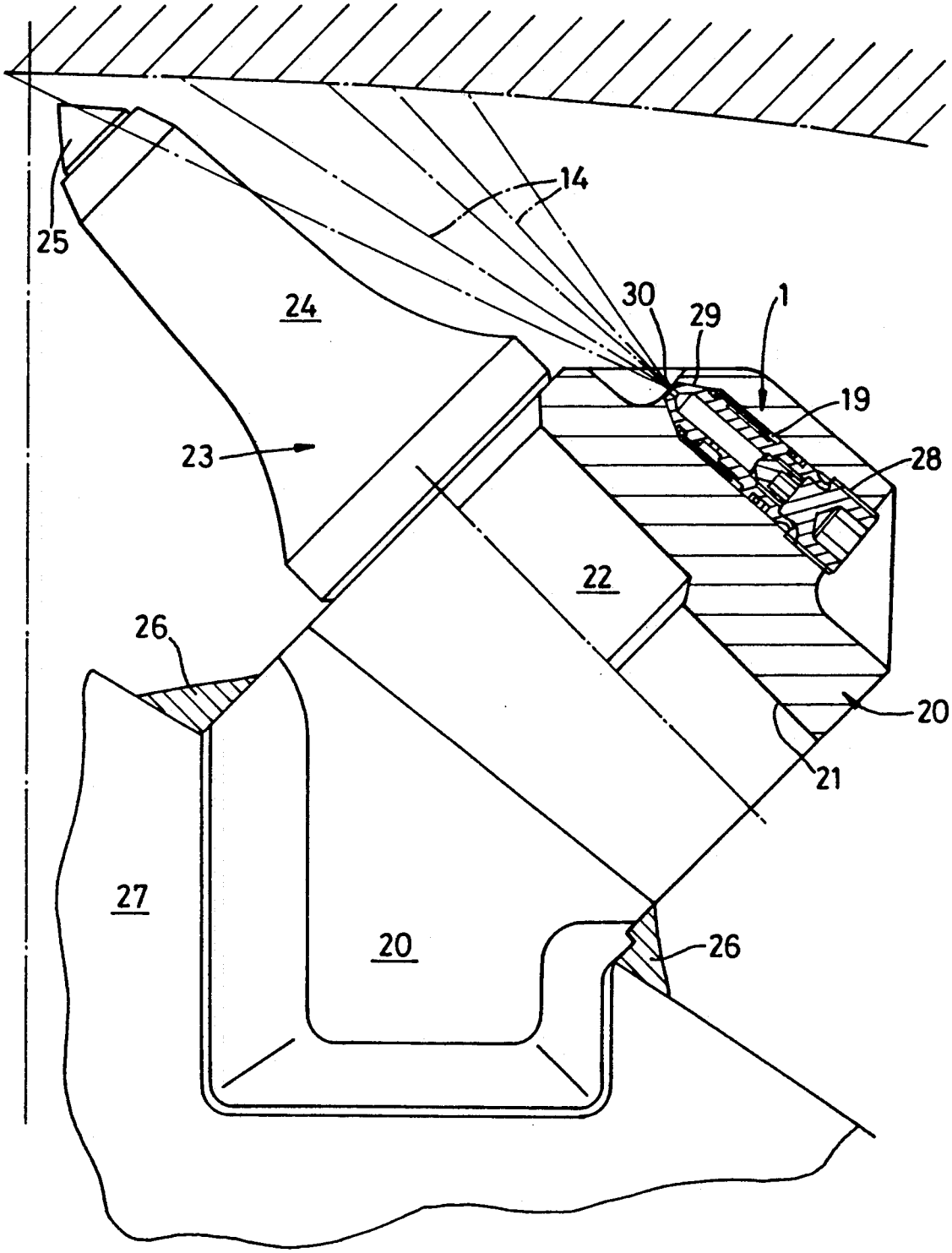

FIGS. 4A and 4B correspond to FIG. 4 but show different misaligned positions;

FIGS. 5 and 5A show another construction of the articulated embodiment of FIGS. 4 to 4B; and FIG. 6 shows partly in section the water spray of FIG. 3, located in a pick box in accordance with the second aspect, mounted on a rotary cutting head in accordance with the third aspect.

In FIGS. 1-5A, like reference numerals are used for like components.

Water spray unit 1, comprises a first component in the form of a nozzle portion 2 and a second component in the form of fastener 3.

The nozzle portion 2 is generally cylindrical, having a longitudinal axis 4. Internally, the nozzle portion 2 is provided with a water chamber 5, supplied with water via a radial orifice 6 protected by a wire mesh filter sleeve 7 retained by an 'O'-ring 8 in a circumferential groove 9. Another 'O'-ring 10 is located in a circumferential groove 11 together with a pair of backing rings 12. At one, inner end, the nozzle portion 2 is provided with a water discharge orifice 13 co-axial with the longitudinal axis 4, to provide a water spray 14 (see FIG. 5), while the leading or inner end of the nozzle portion 2, terminates in a frusto-conically tapered nose 15. The fastener 3 has a longitudinal axis 16 and is provided with an external thread 17 and an internal hexagon socket 18 to receive an Allen key.

As indicated in FIG. 6, the water spray unit 1 is entered, from the rear, into a bore 19 of a pick box 20 provided with an aperture 21 to receive a shank 22 of a cutter pick 23 having a head 24 provided with a tungsten carbide tip 25. The box 20 is secured by welds 26 to a rotary cutting head 27.

In detail, the bore 19 is of internal diameter slightly greater than the external diameter of the water spray unit 1. At its outer end, the bore 19 is provided with screw threads 28 and at its inner end with a frusto-conical seat 29 leading to an aperture 30 with which the discharge orifice 13 is adapted to be aligned in close proximity.

Figure 1:
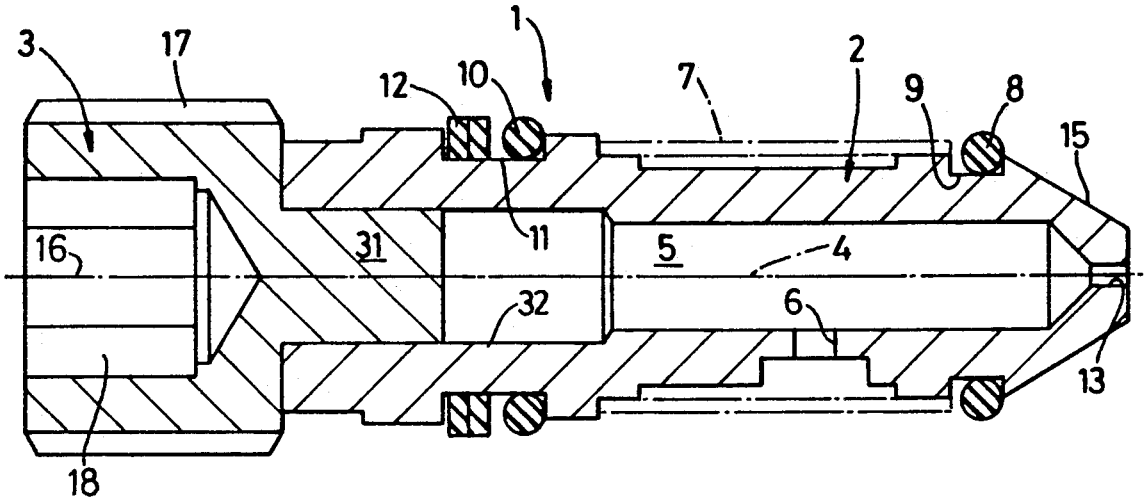
FIG. 1 is a longitudinal section through a first embodiment of water spray.

Reverting now to FIG. 1, it will be observed that the fastener 3 illustrated is provided with an integral circular section nose 31, which is s tight, push fit within a counterbored extendsion 32 of the water chamber 5, the nose 31 serving firstly as a water plug for the end of the water chamber 5 distal from the discharge orifice 13 and secondly transmitting torque, and hence rotation, to the nozzle portion 2 during screwing in of the water spray unit 1 (to bring the nose 15 into tight, water sealing engagement with the seat 29) or unscrewing of the water spray unit 1, (for cleaning etc.).

In practice however, tap wander, during cutting of the threads 28, may frequently result in the thread 28 not being aligned with sufficient accuracy with the bore 19. This would result in difficulties, or on some occasions the impossibilty, of inserting water spray units in accordance with the FIG. 1 embodiment into the bores 19, particularly in the awkward confines of a mine environment.

Figure 2:
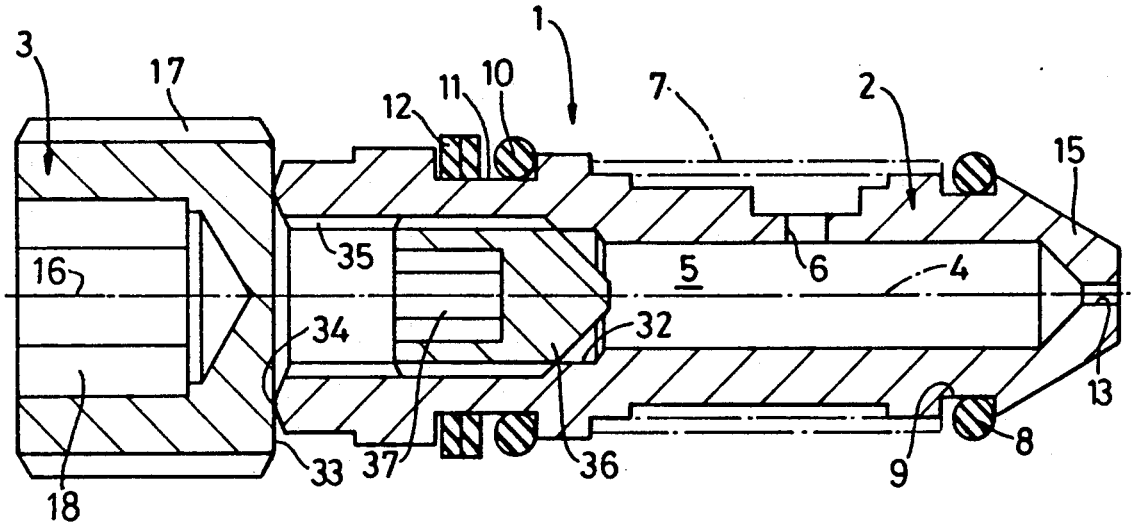
FIG. 2 is a longitudinal section through a second embodiment of water spray.

This problem is overcome, although the advantage of a one piece water spray unit is lost, by the development of the two-piece water spray unit in FIG. 2, where the nozzle portion 2 is quite separate from the fastener 3. A bearing face 33 of the fastener 3 abuts an annular rib 34 of the adjacent end of the nozzle portion 2, to push, and advantageously not necessarily to rotate, the nozzle portion 2 along the bore 19 until tight seating engagement is achieved between the frusto-conical nose 15 and seat 29, while the extension 32 is tapped at 35 to receive a screw-in water plug 36 with an internal hexagon socket 37 to recive an Allen key. Whilst the FIG. 2 water spray overcomes the non-alignment problem, it was found that upon unscrewing of the faster 3, the nozzle portion 2 frequently remained stuck in situ, thus requiring the carrying of an extraction tool, and being awkward to use in the confines of an underground environment. Also, as the fastener 3 is only some 5–10mm in diameter, its insertion underground is awkward, it can become dropped and lost in the debris on a mine floor, or the fastener 3 and nozzle portion 2 may be provided in odd numbers rather than, correctly, in pairs.

Two embodiments of water spray units and depicted in FIGS. 3, 4, 4A, 4B, 5 and 5A overcome the potential practical difficulties envisaged with the water spray units of both FIG. 1 and FIG. 2.

In both FIGS. 3, 4, 4A, 4B, 5 and 5A the nose 31 of the fastener 3 functions as a ball and socket type articulated connection 38 between the first and second components. In detail, the nose 31 has a neck 39 and a cupped end 40 of the nozzle portion 2 is crimped or swaged radially inwardly towards the neck 39, with an annular clearance gap 41 in the correctly, aligned position illustrated in FIGS. 3 and 4. Hence, as illustrated in FIG. 4A, any axial misalignment of the thread 28 with the bore 19 (and hence axes 4 and 16 not being co-axial as intended but being misaligned with axis 16 displaced to position 16A) is of no consequence as the cupped end 40 is deformable by the nose 31. Similarly, as illustrated in FIG. 4B, misalignment of the thread 28 and the bore 19, whereby the axis 16 is displaced to position 16B, is again of no consequence as this likewise can be accommodated over 360° due to the presence of the articulated connection 38. Also, the handling and other difficulties of the FIG. 2 embodiment are avoided, while advantageously the nozzle portion 2 is not rotated upon screwing or unscrewing the fastener 3.

Furthermore, upon unscrewing e.g. for cleaning or replacement, the fastener 3 via the articulated connection 38 reliably pulls any sticking nozzle oportion 2 from the bore 19, and hence no extraction tool, or extraction tool operation, is necessary.

In the embodiments of FIGS. 4 to 5A, the water plug 36 is omitted, the nose 31 is provided with a spherical outer surface 42 and the extension 32 is provided with a frusto-conical sealing surface 43.

Finally, as illustrated in FIG. 5 and 5A, the possibility exists of supplying the nozzle portion 2 and fastener 3 as two separate components, with the crimping or deforming of the cupped end 40 effected in situ, in the bore 19. In detail, the fastener 3 is provided with an annular skirt 44 with an inclined inner face which, together with the adjacent outer periphery of the nose 31 defines an inwardly tapering, annular gap 45. Thus, progressive screwing of the fastener 3 along with the bore 19 forces the cupped end 40 of the nozzle portion 2 into the gaps 45, gradually deforming the cupped end 40 until the position illustrated in FIG. 5A is attained, in which the cupped end 40 engages behind the neck 39.

What we claim is:

1. A water spray unit adapted, in use, to be located in a receiving bore provided in a pick box, said water spray unit comprising an elongate nozzle portion and a fastener for said nozzle portion, and internal water-receiving chamber provided in said nozzle portion, a water inlet orifice in communication with said chamber and, at one end of said nozzle portion, a water discharge orifice in communication with said chamber, an external screw thread provided on said fastener and drive surfaces also provided on said fastener for screwing or unscrewing, with said one end of said nozzle portion being distal from said fastener and terminating in a nose having a frusto-conical sealing surface, adapted, in use, to be forced by said fastener, in tight, water-sealing engagement with a complementary frusto-conical seat of said receiving bore.

2. A water spray unit as claimed in claim 1, wherein said nozzle portion is cylinder-like having a longitudinal axis.

3. A water spray as claimed in claim 2, wherein said water discharge orifice is co-axial with said longitudinal axis, to provide a water spray.

4. A water spray unit as claimed in claim 1, wherein a radial extending water inlet orifice supplies said water chamber with water, a wire mesh filter protects said orifice, a circumferential groove is provided in said nozzle portion, an 'O'-ring is located in said circumferential groove, said 'O'-ring serving to retain said filter.

5. A water spray unit as claimed in claim 4, wherein a further circumferential groove is provided in said nozzle portion, a further 'O'-ring is located in said circumferential groove, and a pair of backing rings are also located in said further circumferential groove.

6. A water spray as claimed in claim 1, wherein said fastener has a longitudinal axis and an internal hexagon socket constituting said drive surfaces.

7. Water spray as claimed in claim 1, wherein said nozzle portion and fastener are rigidly interconnected to form a one-piece spray unit.

8. A water spray unit as claimed in claim 7, wherein an integral, circular section nose is provided on said fastener, a counterbored extension of said water chamber is provided, said nose being a tight, push fit within said counterbored extension.

9. A water spray unit as claimed in claim 1, wherein said nozzle portion and said fastener are formed as separate elements to constitute a two-piece spray unit.

10. A water spray unit as claimed in claim 9, wherein a bearing face is provided on said fastener and an annular rib is provided on an adjacent end of said nozzle portion, said bearing face being adapted to abut said annular rib.

11. A water spray unit as claimed in claim 1, wherein said nozzle portion and said fastener are loosely interconnected via an articulated joint.

12. A water spray unit as claimed in claim 11, wherein a nose of said fastener functions as a ball of a ball and socket type articulated connection between said nozzle portion and said fastener.

13. A water spray unit as claimed in claim 12, wherein said nose has a neck, and a cupped end of the nozzle portion is crimped or swaged radially inwardly towards said neck with an annular clearance gap.

14. A water spray unit as claimed in claim 13, wherein an annular skirt is provided on said fastener, said skirt, together with the external periphery of said nose, defines an inwardly tapering annular gap, into which said cupped end is progressively deformed during screwing of the fastener.

15. A pick box to receive, releasably, a mineral cutter pick, provided with a rear entry bore in which is housed a water spray comprising an elongate nozzle portion and a fastener for said nozzle portion, an internal water-receiving chamber provided in said nozzle portion, a water inlet orifice in communication with said chamber and, at one end of said nozzle portion, a water discharge orifice in communication with said chamber, an external screw thread provided on said fastener and drive surfaces also provided on said fastener for screwing or unscrewing, with said one end of said nozzle portion being distal from said fastener and terminating in a nose having a frustoconical sealing surface, adapted, in use, to be forced by said fastener, in tight, water-sealing engagement with a complementary frustoconical seat of said receiving bore.

16. A rotary mineral cutting head, provided with an array of pick boxes each of which pick boxes is adapted to receive, releasably, a mineral cutter pick, and each of which pick boxes is provided with a rear entry bore in which is housed a water spray comprising an elongate nozzle portion and a fastener for said nozzle portion, an internal water-receiving chamber provided in said nozzle portion, a water inlet orifice in communication with said chamber and at one end of said nozzle portion, a water discharge orifice in communication with said chamber, an external screw thread provided on said fastener and drive surfaces also provided on said nozzle portion being distal from said fastener and terminating in a nose having a frustoconical sealing surface, adapted, in use, to be forced by said fastener, in tight, water-sealing engagement with a complementary frustoconical seat of said receiving bore.

* * * * *